United States Patent [19]

Krulwich

[11] 4,237,518

[45] Dec. 2, 1980

[54] NONELECTRIC MAGNETIZER AND DEMAGNETIZER

[76] Inventor: Lester S. Krulwich, 241 Central Park West, New York, N.Y. 10024

[21] Appl. No.: 38,250

[22] Filed: May 11, 1979

[51] Int. Cl.[3] .....H01F 13/00

[52] U.S. Cl. ..... 361/267; 335/284; 335/303; 335/306

[58] Field of Search ..... 361/267; 335/284, 303, 335/306

[56] References Cited

U.S. PATENT DOCUMENTS

| | | | |
|---|---|---|---|
| 2,904,364 | 9/1959 | Korodi . | |
| 3,281,742 | 10/1966 | Kaplan et /al. | |
| 3,331,043 | 7/1967 | Orzabal . | |
| 3,349,354 | 10/1967 | Miyata . | |
| 3,418,613 | 12/1968 | Trikilis . | |
| 3,467,926 | 9/1969 | Smith . | |
| 3,662,303 | 5/1972 | Arllof | 335/284 |
| 3,750,068 | 7/1973 | Hallin . | |
| 3,858,136 | 12/1974 | Jun . | |
| 3,971,054 | 7/1976 | Jasinski . | |

*Primary Examiner*—Harry E. Moose, Jr.

[57] ABSTRACT

A nonelectric magnetizer and demagnetizer in the form of three flexible permanent magnets, approximately crescent U shaped, each having only one same magnetic pole on its main curved in surface and the opposite magnetic poles on their main curved out surfaces, with two of the flexible permanent magnets pliably mounted on one backing, having their curved in surfaces angularly facing each other, and the other magnet mounted on a separate backing manually movable so that the three magnets can form an adjustable air gap from substantially all directions within which a workpiece can be inserted and withdrawn to be magnetized, and the curved outside of the single magnet capable of demagnetizing various workpieces.

7 Claims, 5 Drawing Figures

NONELECTRIC MAGNETIZER AND DEMAGNETIZER

This invention relates to a nonelectric device for magnetizing and demagnetizing various workpieces. Magnetized instruments are useful almost daily in handling our complex mechanisms, condensed circuits and other assemblies. The average person lacks the skill and facilities and cannot afford to magnetize workpieces electrically. Yet every aspect of magnetic energy should be utilized in view of the diminishing fuel supply. Available devices to magnetize and demagnetize workpieces operate with electric currents, are very high priced or structurally weak in accomplishing their purposes.

An important object of this invention is to provide a nonelectric magnetizing and demagnetizing apparatus that operates easily, rapidly and is effective in magnetizing and demagnetizing various workpieces.

Another object of this invention is to provide an apparatus that is readily adjustable so as to apply the maximum flux gap for the workpiece being magnetized and demagnetized.

Another object of this invention is to provide an improved magnetizer with magnetic domains applying their flux gaps on the workpiece being magnetized from substantially all sides.

Another object of this invention is to provide a nonelectric magnetizer and demagnetizer with which the magnetic fields are manually adjustable to accommodate a wide variety of shapes and sizes of workpieces.

Another object of this invention is to provide a nonelectric apparatus capable of magnetizing and demagnetizing, sufficiently saturating the magnetism to stabilize and render the magnetism and demagnetism durable.

Another object of this invention is to provide a nonelectric magnetizer and demagnetizer that is relatively inexpensive to make.

Further objects and structural details of the invention will be apparent from the following description when read in conjunction with accompanying drawings forming a part of this specification, wherein.

Figure 1:
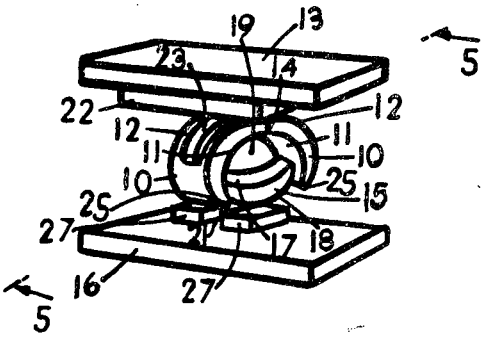
FIG. 1 is a perspective view of an embodiment of my invention with the backings manually pressed partly together, without the elastic bands.
Figure 2:
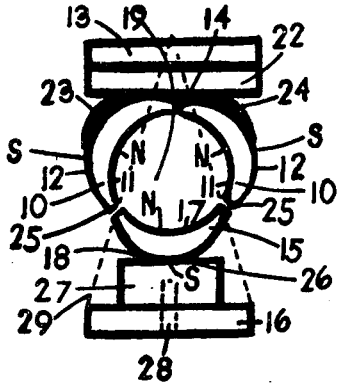
FIG. 2 is a front side view showing the combined magnetic field before it is fully formed by the three magnets, and with broken lines indicating one set of the elastic bands before the backings are in their initial position.
Figure 3:
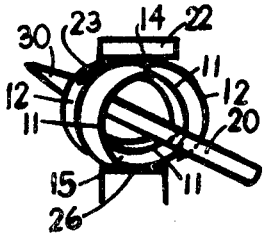
FIG. 3 is a slightly perspective view of the three magnets partly pressed together, curved triangularly around the combined magnetic field into which a center punch is inserted.
Figure 4:
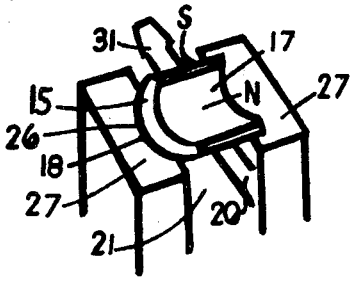
FIG. 4 is a perspective view of the single magnet on its two platforms demagnetizing the screw driver having its tip and blade under the curved out side of the magnet.
Figure 5:
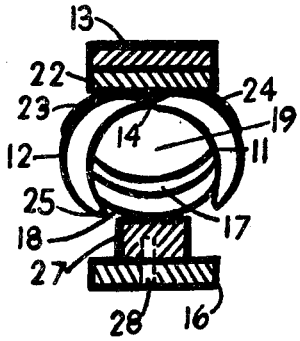
FIG. 5 is a section on line 5—5 of FIG. 1.

Upon reference to the drawings in detail, they show a nonelectric magnetizer and demagnetizer apparatus comprising two flexible permanent magnets 10 preferably with curved backs, approximately crescent U shaped, each having the same magnetic pole, for example North, on the entire surface that is curved inward 11, with the other magnetic pole, for example South, on the surfaces curved outward 12. The two magnets 10 are mounted on a nonmagnetic backing 13 with one side end 14 of each adjacent to the other, and their curved in 11 surfaces angularly and openly facing each other. Another magnet 15 of the same material and about the same shape and size is mounted on another backing 16 with its inward 17 and outward 18 curved surfaces having the same polarity arrangement as the magnets 10 on the other backing 13. This magnet 15 is centrally aligned with the adjacent line 14 between the other magnets 10 so that when the two backings 13, 16 and their three flexible repelling magnets 10,15 are brought to each other the curved in surfaces and ends of these three repelling flexible magnets 10,15 and their magnetic fields sufficiently join together and provide a central flux gap 19 adjustably spaced and sized from substantially all directions to accommodate the insertion and withdrawal of various workpieces 20 and effectively magnetize them. The single magnet 15 also contains the adjustable space 21 under its outward curved 18 surface for demagnetizing workpieces 20 of various sizes.

The magnets are preferably formed out of flexible permanent magnetic strips or sheets having their domains aligned so that the entire surface of each main side has a different magnetic pole, for example magnetic strips $\frac{3}{4}$ inches wide and 5/6 inches thick formed into about one inch curved approximately crescent U shaped lengths. Thereby all of the magnetic fields of the curved in sides, angularly facing each other, adjustably and jointly repel each other and magnetize from substantially all directions. And the curved out face can still efficiently demagnetize.

The backing 13 having the two magnets 10 is of nonmagnetic material, such as wood or plastic and optionally oblong, for example three inches long, one and 3/8 inch wide and $\frac{1}{4}$ inch thick with a short platform 22 of the same thickness and nonmagnetic material as its backing 13. A pliable curved strip 23, such as spring steel, is centrally fastened on the platform 22. This curved strip 23, especially if it is of steel, has fastened over it, behind the two magnets 10, a curved nonmagnetic piece 24, such as plastic. The curved out 12 sides of the two magnets 10 are attached to this with one side 14 of each magnet 10 adjacent to each other, leaving the two curved in 11 surfaces, with the same polarity, angled outward, slantingly facing each other. The two extended side edges 25 of all the magnets 10,15 are slanted in slightly towards the curved in 11,17 faces.

The other backing 16, also of nonmagnetic material, is optionally of the same size and shape as the first backing 13 and the magnet 15 mounted on it is, preferably, approximately of the same shape, size and flexible permanent magnetic material as the other magnets 10, with its curved in 17 surface having the same polarity and facing outward. The magnet 15 is suitably and strongly fastened near the bottom side edges 26 on its curved out 18 side on two platforms 27 on the backing 16 which are spaced apart so as to leave an opening 21 between them under the magnet 15 for the insertion and demagnetization of a workpiece 20. The platforms 27 are preferably removably attached to the backing 16 so as to optionally leave the space 21 under the magnet 15 more or entirely open, for example with the two posts 28 fastened on the backing 16 and each extending partly up into each platform 27, frictionally but freely engaging each platform 27 and allowing the platforms 27 to be pulled off partly or fully with the magnet 15 remaining on them.

The backings 13,16 are brought together manually but can initially be postioned together to the extent that the magnetic field of the single magnet 15 just reaches the repelling fields of the two magnets 10, and with a suitable holding means such as elastic bands 29 fastened to and extending from the backing 13 of the two magnets 10 over and removably around the side ends of the other backing 16. In this way the single magnet 15 and its backing 16 can mostly or entirely be separated from the two magnets 10 during demagnetization.

The apparatus may be of different sizes and shapes to accommodate various workpieces, additional repelling and other magnets may be included. The curved strip 23 may be made of plastic or other nonferrous material and in that case the shielding piece 24 may be eliminated.

OPERATION OF THE APPARATUS

For informal use of the device the magnetizer is held in one hand and the two backings 13,16 pressed partly together. A center punch 30, for example, is inserted through a narrow side into the curved-sided triangular air gap 19 formed by the three magnets 10,15 and the center punch 30 is casually withdrawn. It does not matter whether or not it touched against the inside surfaces of the magnets 10,15. The center punch 30 or other instrument can then magnetically and instantly adhere to and pick up washers, screws, nuts, tacks and other magnetically attractable things. A long list of workpieces 20 can and have been magnetized this way in testing the device, like center punches, chisels, files, screw drivers, pliers, knives, drill bits, steel scissors, iron rods, ice picks, augers and saw blades. Some instruments cannot be magnetized like nonferrous ones, those zinc coated, of certain compositions and other items. The air gap 19 can be enlarged or made smaller by manually separating or bringing the backings 13,16 to each other, enabling workpieces 20 of different shapes and sizes to be magnetized effectively. The flexibility of the magnets is very helpful in forming the air gap 19 when the magnets 10,15 are drawn together. The device not only retains its magnetizing strength but over a long stretch of time none of these magnetized workpieces 20 has lost its magnetic ability. Even if it did, it takes only a few moments to slip it in and out to remagnetize. The combined adjustable and repelling magnetic fields, by operating on substantially all sides of the workpieces 20 increase the flux output and the magnetic saturation.

For more precise use, the extent of the air gap 19 formed by the magnets 10,15 should be manually adjusted or set for the particular workpiece 20 being magnetized. The flux output is affected by its application. It can vary for different shapes and kinds of instruments and sometimes it might even be more effective if the backings 13,16 are farther apart. For this reason structures with fixed positions may not be fully effective in magnetizing. Also ferrous plating or other neighboring magnetic parts can adversely affect the flux gap. In this structure the backings 13,16 and platforms 22,27 are nonferrous.

In demagnetizing, the backing 16 with the single magnet 15 is moved away from the other backing 13, either by shifting it sidewise or removing it from the elastic bands 29. A magnetized screw driver 31 for example is then slipped in and out from between the platforms 27 under the curved out 18 surface of the magnet 15. Until a maximum line in the flux gap is ascertained for this workpiece 20 it is better to let it touch lightly and passingly on the curved out side 18 of that magnet 15. The opposite field under the magnet 15 readily demagnetizes the screw driver 31, but the strong magnetic field of the joint repelling force of the other magnets 10 may extend and hamper or destroy the demagnetizing, so the backings 13,16 are separated.

Just as the two backings 13,16 can be separated to accommodate various sizes and shapes, the space 21 under the single magnet 15 can be expanded or entirely opened. The posts 28 attached to the backing 16 can be pulled out partly or removed entirely from the platform 27 leaving the space 21 open.

I have described preferred embodiments of my invention but it is understood that various changes may be made in the form, details, arrangements and proportions of the various parts without departing from the scope of my invention.

What I claim is:

1. A magnetizer and demagnetizer apparatus that operates without electricity comprising a plurality of permanent magnets adjustably mounted on two backings detachable from each other and capable of being manually brought to each other with said magnets aligned so that when the two backings are brought partly together, thereby engaging the magnets, each of said magnets angularly and repellingly face each other with the same magnetic polarity, with said magnets substantially surrounding and adjustably forming an air gap containing a combined magnetic field into and through which workpieces of various sizes and shapes may be inserted and withdrawn to be magnetized.

2. A magnetizer and demagnetizer apparatus that operates without electricity according to claim 1, with one of said magnets attached on one of said backings, on its side opposite the sides of the magnets that repellingly face each other, and the attached side of said magnet containing under it an adjustable open space into which a magnetized workpiece can be inserted and withdrawn to be demagnetized.

3. A magnetizer and demagnetizer apparatus that operates without electricity according to claim 1, with each of said magnets having one and the same magnetic pole on one of its entire main surfaces and the opposite magnetic pole on the entire main surface of the other side.

4. A magnetizer and demagnetizer apparatus that operates without electricity according to claim 1, with all of said magnets being approximately U shaped and having a curved in and curved out side.

5. A magnetizer and demagnetizer apparatus that operates without electricity according to claim 1, said magnets consisting of flexible, permanent magnetic material.

6. A magnetizer and demagnetizer apparatus that operates without electricity according to claim 1, having two of said magnets mounted on one of said backings and one of said magnets mounted on the other backing, said backings consisting of nonmagnetically attractable material.

7. A magnetizer and demagnetizer apparatus that operates without electricity according to claim 1, the backings being movably and removably kept by adjustable holding means in their initial position with the repelling magnetic fields just reaching each other.

* * * * *